US005187405A

United States Patent [19]

Rachel et al.

[11] Patent Number: 5,187,405

[45] Date of Patent: Feb. 16, 1993

[54] DOUBLE FILAMENT INCANDESCENT LAMP

[75] Inventors: Bernard W. Rachel, Highland Heights; Richard C. LeCrone, Chesterland, both of Ohio; Michael W. Bowen, Memphis, Tenn.

[73] Assignee: General Electric Company, Schenectady, N.Y.

[21] Appl. No.: 888,301

[22] Filed: May 26, 1992

Related U.S. Application Data

[63] Continuation of Ser. No. 658,204, Feb. 21, 1991, abandoned.

[51] Int. Cl.[5] ..... H01J 1/88

[52] U.S. Cl. ..... 313/316; 313/272

[58] Field of Search ..... 313/316, 315, 271, 272, 313/275

[56] References Cited

U.S. PATENT DOCUMENTS

| | | | |
|---|---|---|---|
| 1,909,084 | 5/1933 | Wilson | 313/316 |
| 3,364,377 | 1/1968 | De Nygordeu et al. | 313/316 |
| 3,590,305 | 6/1971 | De Caro | 313/272 |
| 3,736,454 | 5/1973 | Huyskens | 313/316 |
| 4,553,066 | 11/1985 | Fields et al. | 313/272 |
| 4,605,877 | 8/1986 | Cho et al. | 313/316 |
| 4,686,412 | 8/1987 | Johnson | 313/315 |

OTHER PUBLICATIONS

1991 SAE Ground Vehicle Lighting Manual, HS34, SAE J1383, pp. 181-293; Jun. 1990.

*Primary Examiner*—Donald J. Yusko
*Assistant Examiner*—Nimesh Patel
*Attorney, Agent, or Firm*—George E. Hawranko; Stanley C. Corwin

[57] ABSTRACT

The incandescent lamp includes a glass bulb having a longitudinal axis and two filaments formed of a coil within the bulb supported with their longitudinal axes oriented parallel to the bulb's longitudinal axis. For supporting the filaments, three support wires are provided, each with an outer portion fixed to the bulb and extending parallel to the bulb longitudinal axis and an inner portion extending substantially perpendicular to the outer portion. The inner and outer portions of all three support wires are located in a single reference plane extending parallel to the bulb longitudinal axis. The filaments are joined to the support wires by four welded joints that can be applied in the single reference plane. The inner portions of the second and third support wires extend toward each other and are substantially aligned. The bulb has a glass seal portion through which the outer portion of the support wires extend and by which the outer support wire are fixed in a laterally spaced apart relation. An exhaust tube also extends through the glass seal portion between the second and third support wires.

13 Claims, 2 Drawing Sheets

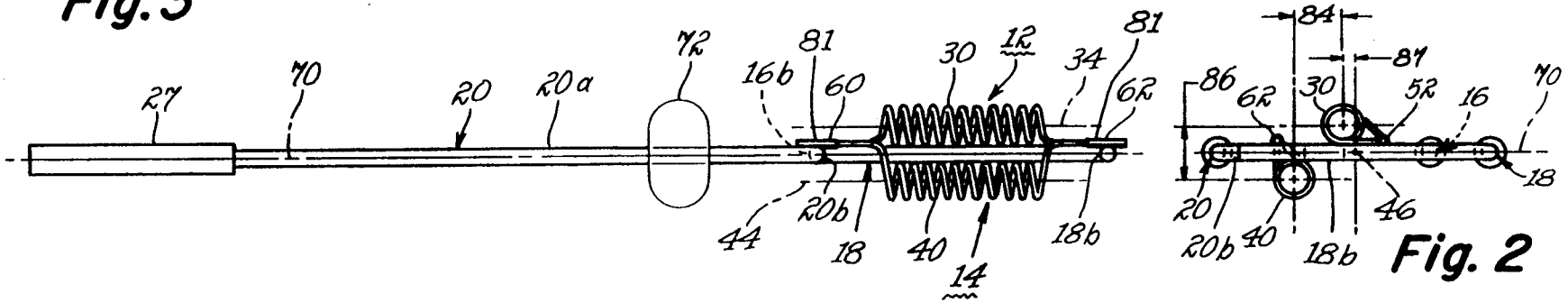
Fig. 2
Fig. 3
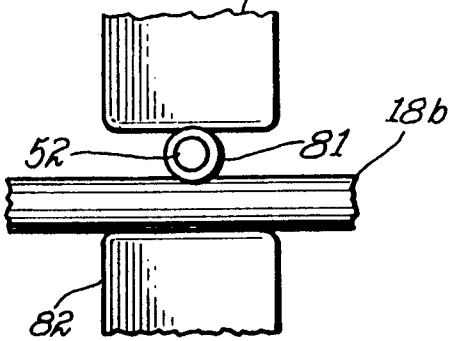
Fig. 5
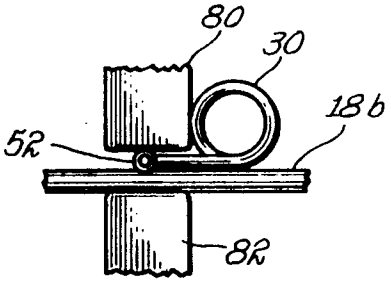
Fig. 4

DOUBLE FILAMENT INCANDESCENT LAMP

This application is a continuation of application Ser. No. 07;658,204, filed Feb. 21, 1991, now abandoned.

This invention relates to an incandescent lamp that is designed for use as a replaceable light source within a vehicle headlamp and, more particularly, relates to a lamp of this type which comprises a bulb and two filaments within the bulb, each filament comprising a coil having its longitudinal axis oriented substantially parallel to the longitudinal axis of the bulb. Lamps of this type are currently designated by the industry as Type HH5 lamps.

BACKGROUND

For supporting the filaments of such a lamp within the bulb of the lamp, it is conventional to provide within the bulb support wires, each secured at one end to the bulb and secured at its opposite end to one terminal of a filament. To position the filaments in the precise positions required, it has typically been necessary to provide support wires of complex shape and/or filaments of complex design. These shape and design complexities have made it difficult and unduly expensive to manufacture an appropriate assembly from these components.

OBJECT

An object of our invention is to provide, for such a lamp, a double-filament and support wire assembly which comprises simple and easily-manufactured components that can readily be combined into an assembly in which the filaments are located in the precise positions required for vehicle headlamp use.

Another object of our invention is to provide a Type HB5 lamp that is constructed in such a manner that it is able to utilize an exceptionally simple support wire assembly for locating the two filament coils in the precise positions with respect to each other and with respect to the longitudinal axis of the lamp that are called for by the applicable industry recommended practice. The current industry recommended practice in the United States is Society of Automotive Engineers' Recommended Practice SAE J1383.

Still another object is to attain the preceding objects in a lamp that comprises a glass bulb including a seal portion for mounting the support wires and an exhaust tube that extends through the seal portion and, more specifically, to locate the support wires in such a manner that sufficient space is provided between them to readily accomodate the exhaust tube.

Another object is to make the support wires of this type of support-wire assembly of such a cross-section that they provide a high degree of glass-to-metal seal integrity and at the same time high shock and vibration strength.

SUMMARY

In carrying out the invention in one form, we provide a lamp that comprises a glass bulb having longitudinal axis and two filaments within the bulb. Each filament comprises: (a) a coil having a longitudinal axis extending between its ends, (b) two legs at opposite ends of the coil that are laterally offset from and are substantially parallel to the longitudinal axis of the coil, and (c) two arms extending laterally of the coil axis and respectively connecting said legs to the ends of the associated coil. The two filaments are supported within the bulb with their longitudinal axes oriented substantially parallel to the bulb longitudinal axis by support means that comprises three support wires located within the bulb. Each support wire comprises an outer portion fixed to the bulb and extending substantially parallel to the longitudinal axis of the bulb and an inner portion at one end of the outer portion extending substantially perpendicular to the outer portion. The inner and outer portions of all three support wires are located in a single reference plane extending substantially parallel to the longitudinal ax-s of the bulb. The support means further comprises four welded joints, which are respectively located as follows: (1) between one leg of one coil and the inner portion of a first one of the support wires, (2) between the other leg of said one coil and the inner portion of a second one of the support wires, (3) between one leg of the other of said coils and the inner portion of said first support wire, and (4) between the other leg of said other coil and the inner portion of a third one of said support wires. This lamp is further characterized by the longitudinal axes of the two coils being located on opposite sides of the above-described reference plane and also by the two legs of each coil being disposed substantially in alignment with each other. For fixing the outer portions of the support wires to the glass bulb, the bulb is provided with a glass seal portion through which said outer portions of the support wires extend in sealed, laterally spaced-apart relationship; and through this seal portion also extends an exhaust tube for the bulb which is located between said outer portions of said second and third support wires.

In one specific form of the invention, all four of said welded joints are located on one side of said reference plane, and the axes of the two coils are offset from each other along said reference plane.

BRIEF DESCRIPTION OF FIGURES

For a better understanding of the invention, reference may be made to the following detailed description taken in conjunction with the accompanying drawings wherein:

FIG. 2 is an enlarged end view of the assembly of FIG. 1 looking in the direction of the arrows on line 2—2 of FIG. 1.

FIG. 3 is a top plan view of the assembly of FIG. 1.

FIG. 4 shows a resistance-welding operation being used for joining the leg at one end of one of the filaments to a portion of a support wire.

FIG. 5 is an enlarged sectional view of a portion of the structure depicted in FIG. 4 taken in a plane parallel to the viewing plane of FIG. 4.

DETAILED DESCRIPTION OF EMBODIMENT

Figure 1:
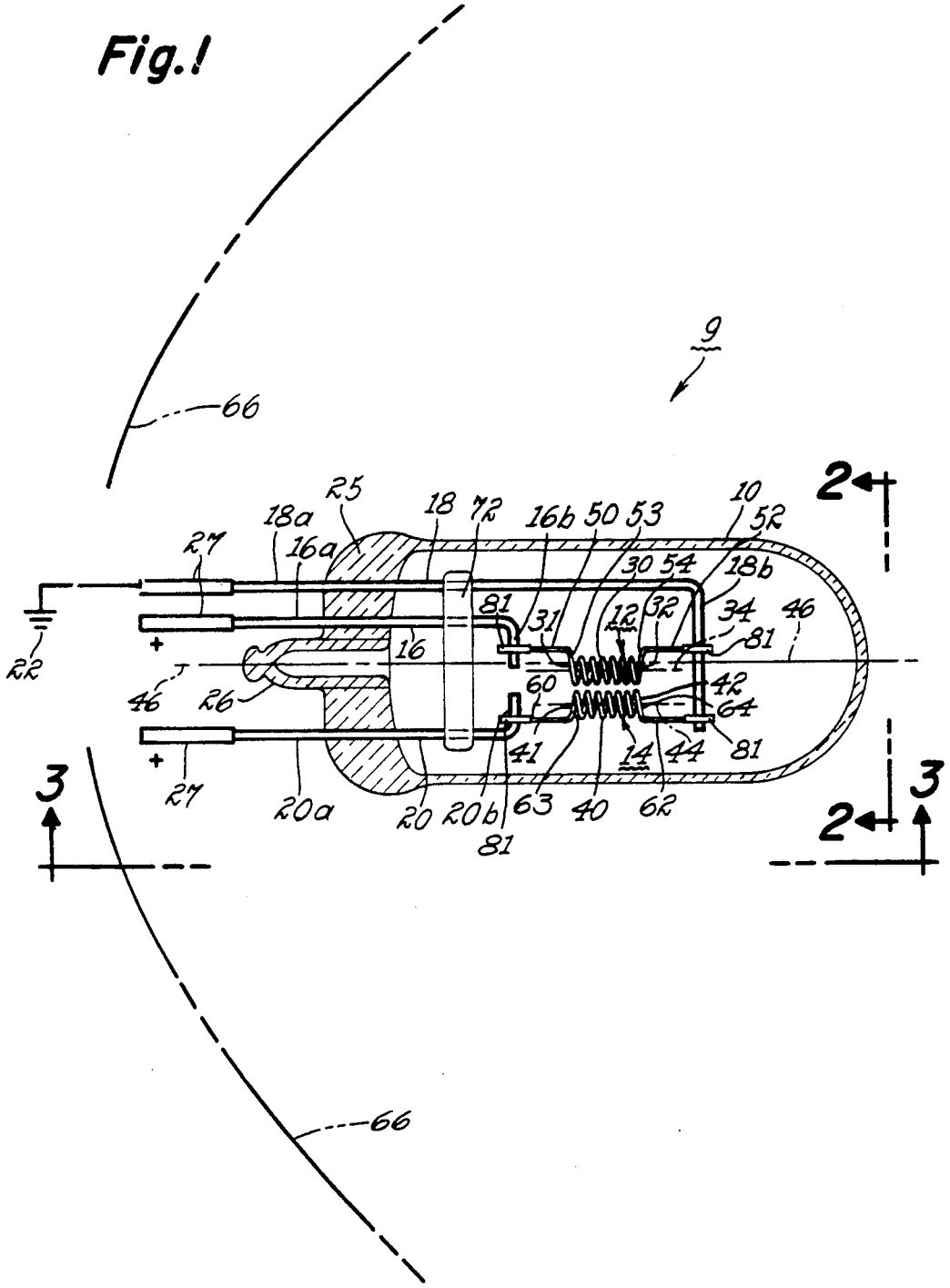
FIG. 1 is a side elevational view showing a double filament incandescent lamp embodying one form of the present invention.

Referring now to FIG. 1, the lamp 9 shown therein is a halogen type incandescent lamp comprising a tubular glass bulb, or envelope, 10 within which are located two filaments 12 and 14 of refractory metal, preferably tungsten. Each of these filaments is supported within the bulb by two spaced-apart support wires that also serve as conductive leads for carrying electric current to and from the associated filament. The leads for filament 12 are designated 16 and 18, and the leads for filament 14 are designated 20 and 18. Lead 18 is common to both filaments and is connected at its left hand end to ground, as indicated at 22. The other two leads 16 and 20 have their left-hand ends connected to an appropriate potential different from ground, as indicated by the plus signs adjacent these ends.

The three leads 16, 18, and 20 are hermetically sealed to the glass envelope, or bulb 10, by a direct leak-proof pinch seal 25 of the glass to the leads. Preferably, each of the leads, at its left hand end, comprises a relatively large diameter wire portion 27 that is brazed or welded to the remainder of the lead. These large diameter wire portions 27 are located outside the glass of the bulb and are preferably of nickel-plated iron. The remainder of the lead is preferably of molybdenum.

Also projecting through the pinch seal 25 and sealed with respect to the surrounding glass is an exhaust tube 26. This exhaust tube is used for evacuating the interior of the bulb and subsequently filling it with an appropriate fill gas. After such filling, the outer end of the exhaust tube is appropriately pinched off. As shown in FIG. 1, the exhaust tube 26 extends through the seal 25 of the bulb in a location between the outer ends 16*a* and 20*a* of the two support wires 16 and 20, respectively.

Referring to FIG. 1 each filament comprises a coil having two opposite ends and a longitudinal axis extending between these opposite ends. In filament 12, the coil is designated 30, its opposite ends are designated 31 and 32, and its longitudinal axis is designated 34. In filament 14, the coil is designated 40, its opposite ends 41 and 42, and its longitudinal axis 44. In the type of lamp we are concerned with, i.e., the HB5 lamp, the two filaments are supported in such a manner that the longitudinal axes (34 and 44) of the filament coils extend substantially parallel to the longitudinal axis 46 of the bulb 10.

Each filament includes at opposite ends of its coil two support legs that extend substantially parallel to the longitudinal axis of the coil but in laterally offset relation to such axis. In filament 12 these support legs are designated 50 and 52. Each of the legs is connected to the adjacent end of its associated coil by an arm that extends laterally of the coil axis. For filament 12 these arms are respectively designated 53 and 54, and for filament 14 the arms are respectively designated 63 and 64. Each filament may be thought of as of a zero end view configuration, (i.e., its support legs extend parallel to the longitudinal axis of its coil, and these support legs are in alignment with each other). Filaments of this particular configuration are conventional and are easily fabricated.

The illustrated lamp 9 is designed to serve as a replaceable inner light source for a vehicle headlamp. Such headlamp has a reflector, schematically illustrated as reference numeral 66 in FIG. 1, which partially surrounds the lamp. The lamp is fixedly mounted in its illustrated position within the reflector 66 by suitable mounting means (not shown) which is of a conventional form. The filament 12 is designed to serve as a low beam filament and is positioned at the focus of the reflector. The other filament 14 is positioned slightly off the focus to form a high-beam filament. It is well understood that in such a headlamp the filaments must be precisely positioned with respect to the reflector to serve effectively in their intended manner. The Society of Automotive Engineers (SAE) has issued certain Recommended Practices in this field which specify, among other things, where the coil axes should be located with respect to each other and with respect to the axis (46) of the bulb. The applicable current Recommended Practice is SAE J1383.

We are able to effect precise positioning of the filaments using components of a simple easily-manufactured design. More specifically, the support wires 16, 18, and 20 are of a simple configuration since each contains only one right-angle bend. This bend divides each wire into an outer portion that is fixed at its outer end to the bulb and an inner portion that is disposed perpendicular to the outer portion. The outer and inner portions of support wire 18 are respectively designated 18*a* and 18*b*. The outer support wire 16 are respectively designated 16*a* and 16*b*; and the outer and inner portions of support wire 20 are respectively designated 20*a* and 20*b*. The outer and inner portions of all three support wires are located in a single reference plane 70, shown in FIGS. 2 and 3, that extends parallel to the bulb axis 46. The central longitudinal axis 46 of the bulb 10 is located midway between the outer portions 18*a* and 20*a* of the support wires 18 and 20, respectively. This axis 46 extends parallel to the outer support wire portions 18*a* and 20*a* and is located substantially in the reference plane 70.

A glass cane bridge 72 of conventional form extends between the three support wires at a location near the inner portions of support wires 16 and 20 and is joined to the support wires in this location. This glass bridge imparts to the assembly added strength to resist any shock and vibration to which the lamp may be subjected and also serves to hold the support wires in their desired position with respect to each other when they are being handled during fabrication of the filament and support wire assembly.

Two of the support wires 16 and 20 have their inner portions (16*b* and 20*b*) disposed in alignment with each other. These aligned inner portions 16*b* and 20*b* extend toward each other, but they terminate short of each other so that there is a clearance space between their ends. The other support wire 18 is longer than support wires 16 and 20 and has its inner portion 18*b* spaced along the bulb axis 46 from the aligned inner portions 16*b* and 20*b*.

Low beam filament 12 is connected between the inner portions 16*b* and 18*b* of the lead wires 16 and 18, respectively; and high beam filament 14 is connected 20 and 18, respectively. Referring to the more detailed illustrations of FIGS. 2 and 3, the legs 50 and 52 of coil 30 are respectively connected to the inner portions 16*b* and 18*b* of the support wires 16 and 18, and the legs 60 and 62 of coil 40 are respectively connected to the inner portions 20*b* and 18*b* of the support wires 20 and 18.

Each of the legs 50, 52, 60 and 62 is connected to its associated inner portion of the support wires by means of a welded joint. To facilitate the making of this joint, each leg is constructed so that it includes a sleeve 81 of molybdenum foil encircling and fixed to the tungsten leg portion by a suitable crimping action. The use of molybdenum foil in such welded joints is conventional and is no&. a part of the present invention. For purposes of this application, the molybdenum sleeve may be considered as a part of the filament leg. As shown in FIGS. 4 and 5, the welded joint is formed between leg 52 and inner portion 18*b* of support wire 18 by a resistance welding operation that involves positioning leg 52 and inner portion 18*b* between two welding electrodes 80 and 82, pressing the electrodes together, thereby forcing the leg 52 and inner portion 18*b* together, and then passing electric current between the electrodes, thereby melting some of the molybdenum inner portion 18*b* and some of molybdenum sleeve 81 at the leg-support wire interface. Upon solidifying, the previously molten metal forms a welded joint at this interface.

As shown in FIG. 2, the filament coils 30 and 40 are positioned on opposite sides of the herein above-described reference plane 70, and they are also spaced from each other along the reference plane 70. More specifically, the coil center lines are spaced from each other along the reference plane 70 by an amount 84. The spacing between the coil center lines considered perpendicular to reference plane 70 is designated 86 in FIG. 2. As also viewed in FIG. 2, legs 50,52 of the coil 30 are positioned upwardly of the center line of coil 30, considered along reference plane 70; and the legs of the coil 40 are positioned downwardly of the center line of coil 40, considered along reference plane 70. By orienting the legs of the two coils so that they are offset from their respective coil axes in opposite directions along the reference plane 70, we are able to provide enough spacing between the welded joints for the legs of coil 30 and those for the legs of coil 40 that the welded joints for the legs of one coil can be easily made without interference from the welded joints for the legs of the other coil.

In making these welded joints, the three support wires 16, 18, and 20, before being incorporated into the bulb 10 but after being joined together with the glass bridge 72, are placed on a horizontal surface so that reference plane 70 is horizontal. Then the legs of coil 30 are placed in predetermined positions atop the inner portions **16*b* and 18*b* and are welded to the inner portions as above described. Then the legs of the other coil 40 are placed in their illustrated position atop inner portions 18*b* and 20*b* and are welded to these inner portions in the same manner as above described. Alternatively, the coil 40 may be placed and welded before the coil 30. Irrespective of the order of these operations, the welded joints are sufficiently spaced along the reference plane 70** that the first-made joints do not interfere with the welding electrodes while they are being used to make the second set of joints.

In positioning the coils 30 and 40 as above described prior to and during welding, the coils are located on the support wire assembly by suitable fixtures (not shown) so that the distances 84 and 86 and the distance 87 between the center line of coil 30 and the axis 46 of the lamp, as measured along reference plane 70, (FIG. 2) are established within the limits specified in SAE Recommended Practice J1383.

A significant feature of the depicted lamp is that we are able to precisely locate the filaments (12,14) in the desired locations within the bulb using simple, easily-assembled and located support wires (16, 18, 20) and yet to provide space for the exhaust tube 26 that extends through the seal 25. In this regard, there is relatively large spacing between the outer end portions (**16*a* and 20*a*) of support wires 16 and 20 resulting from the inner end portions (16*b* and 20*b*) of support wire 16 and 20 projecting toward each other and being aligned. This large spacing provides an ideal space for accommodating the exhaust tube 26**. It is especially to be noted that this spare is provided without any need to change the configuration of the outer ends of the support wires from the simple, straight-line form shown.

Another feature of our lamp is that we have made the support wires 16, 18, and 20 sufficiently small in cross-section in the region where they pass through the pinch seal 25 that a high degree of seal integrity is attained, i.e., a consistently reliable and durable leak-proof seal is achieved between the glass and the molybdenum support wires. At the same time, we have made the support wires large enough in cross-sectional area that a high degree of shock and vibration resistance is achieved with the support wire assembly. For achieving this combination of results, we use molybdenum wire having a circular cross-sectional configuration and a diameter of 20 mils plus or minus one mil.

While we have shown and described a particular emodiment of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. An incandescent lamp comprising:

a lamp envelope constructed of a light transmissive material and having a longitudinal axis associated therewith;

a first and a second filament constructed of a refractory metal disposed within said lamp envelope, said first and second filaments each including a respective one of first and second coils and wherein each of said first and second coils has two legs extending therefrom;

support means for supporting said first and second filaments within said lamp envelope such that the longitudinal axes associated with each filament are aligned in a substantially parallel manner to said lamp envelope longitudinal axis, said support means including a plurality of support wires which extend externally of said lamp envelope on one end such that electrical energy can be coupled to said filaments, and one the other end thereof, extend internally of said lamp envelope such that said coil legs can be mounted thereto, said plurality of support wires including at least one support wire for providing a common electrical connection to said filaments and at least a second and third support wire for providing a separate electrical connection to each of said filaments individually; and wherein said first and second filaments are connected to said plurality of support wires by connection joints such that said first and second coils are disposed on opposite sides of a reference plane extending parallel to said lamp envelope longitudinal axis and further wherein said legs extending from each of said coils are substantially aligned with each other and said connection joints are located on one side of said reference plane.

2. The lamp of claim 1 in which the axes of said two coils are offset from each other along said reference plane.

3. The lamp of claim 1 in which said second and third support wires have inner portions which extend toward each other and are substantially aligned.

4. The lamp of claim 1 in which:

(a) said first support wire has an outer portion which is located at one side of outer portions of said second and third support wires, and (b) said first support wire has an inner portion which is spaced along said longitudinal axis of the lamp envelope from inner portions of said second and third support wires.

5. The lamp of claim 4 in which said inner portions of said second and third support wires extend toward each other and are substantially aligned.

6. The lamp of claim 1 in which said support wires have outer portions which are of a substantially circular transverse cross-section and have a diameter of 20 mils plus or minus one mil.

7. An incandescent lamp comprising:

a lamp envelope constructed of a light transmissive material and having a longitudinal axis associated therewith;

a first and a second filament constructed of a refractory metal disposed within said lamp envelope, said first and second filaments each including a respective one of first and second coils and wherein each of said first and second coils has two legs extending therefrom;

support means for supporting said first and second filaments within said lamp envelope such that the longitudinal axes associated with each filament are aligned in a substantially parallel manner to said lamp envelope longitudinal axis, said support means including a plurality of support wires which extend externally of said lamp envelope on one end such that electrical energy can be coupled to said filaments, and on the other end thereof, extend internally of said lamp envelope such that said coil legs can be mounted thereto, said plurality of support wires including at least one support wire for providing a common electrical connection to said filaments and at least a second and third support wire for providing a separate electrical connection to each of said filaments individually; and wherein said first and second filaments are connected to said plurality of support wires such that said first and second coils are disposed on opposite sides of a reference plane extending parallel to said lamp envelope longitudinal axis and further wherein said legs extending from each of said coils are substantially aligned with each other; and wherein the legs of one of said coils are offset from the axis of said one of said coils in a direction along said reference plane and the legs of the other of said coils are offset from the axis of said other of said coils in an opposite direction along said reference plane.

8. The lamp of claim 7 in which the axes of said two coils are spaced from each other in a direction along said reference plane.

9. An incandescent lamp comprising:

(a) a bulb of light-transmitting material having a longitudinal axis, (b) two filaments of refractory metal within said bulb, each filament comprising:

(b1) a coil having two opposite ends and having a longitudinal axis extending between said ends, and (b2) two legs at said opposite ends of said coil, (c) support means for supporting said filaments with the longitudinal axes of said coils oriented substantially parallel to the longitudinal axis of said bulb, aid support means comprising:

(c1) three support wires within said bulb, each support wire comprising an outer portion fixed to the bulb and extending substantially parallel to the longitudinal axis of the bulb and an inner portion at one end of the outer portion extending substantially perpendicular to said outer portion, the inner and outer portions of said three support wires being located in a single reference plane extending parallel to the bulb longitudinal axis, (c2) a first joint between one leg of one of said coils and said inner portion of a first one of said support wires, and a second joint between the other leg of said one coil and said inner portion of a second one of said support wires, and (c3) a third joint between one leg of the other of said coils and said inner portion of said first support wire, and a fourth joint between the other leg of said other coil and the inner portion of a third one of said support wires and wherein said first and third joints are substantially aligned with each other and said second and fourth joints are substantially aligned with each other, the lamp being further characterized by:

(d) said bulb including a seal portion through which the outer portions of said support wires extend in sealed, laterally spaced-apart relationship, thereby fixing the support wires to said bulbs.

10. The lamp of claim 9 in which said inner portions of said second and third support wires extend toward each other and are substantially aligned.

11. The lamp of claim 9 in which:

(a) the outer potion of said first support wire is located at one side of the outer portions of said second and third support wires, and (b) the inner potion of said first support wire is spaced along said longitudinal axis of the bulb from the inner portions of said second and third support wires.

12. The lamp of claim 11 in which said inner portions of said second and third support wires extend toward each other and are substantially aligned.

13. The lamp of claim 9 in which said outer portions of said support wires are of a substantially circular transverse cross-section and have a diameter of 20 mils plus or minus one mil.

* * * * *